US005944211A

United States Patent [19]

Woodnorth et al.

[11] Patent Number: 5,944,211

[45] Date of Patent: Aug. 31, 1999

[54] CONTAINER SYSTEM INCLUDING AN AIR EVACUATION VALVE

[75] Inventors: Brian E. Woodnorth, Minneapolis, Minn.; Gregory A. Theis, Houlton, Wis.; Roger A. Leenerts, Eagan, Minn.; Richard O. McCarthy, Strongsville; Nick E. Stanca, Westlake, both of Ohio

[73] Assignee: Anchor Hocking Plastics/Plastics Inc., St. Paul, Minn.

[21] Appl. No.: 08/918,824

[22] Filed: Aug. 26, 1997

[51] Int. Cl.[6] ..... B65D 51/16

[52] U.S. Cl. ..... 220/203.13; 220/203.28; 220/367.1; 220/805; 220/806

[58] Field of Search ..... 220/203.13, 203.28, 220/203.29, 231, 240, 281, 305, 806, 805, 803, 782, 793, 361, 363, 367.1, 378, 254

[56] References Cited

U.S. PATENT DOCUMENTS

| | | | |
|---|---|---|---|
| 835,166 | 11/1906 | Staunton . | |
| 2,047,720 | 7/1936 | Wilhelm | 220/803 |
| 2,234,485 | 3/1941 | Connor | 220/803 |
| 3,511,407 | 5/1970 | Palma | 220/203.13 |
| 3,519,163 | 7/1970 | Bardell | 220/782 X |
| 3,895,736 | 7/1975 | Swett | 220/782 |
| 4,057,168 | 11/1977 | Bosshold . | |
| 4,206,499 | 6/1980 | Urbanek et al. | 220/378 X |
| 4,210,255 | 7/1980 | Pan . | |
| 4,380,304 | 4/1983 | Anderson | 220/782 |
| 4,383,422 | 5/1983 | Gordon et al. | 220/231 X |
| 4,658,979 | 4/1987 | Mietz et al. | 220/203.13 |
| 4,976,370 | 12/1990 | Cassel | 220/792 |
| 5,356,026 | 10/1994 | Andress et al. . | |
| 5,363,978 | 11/1994 | Molo | 220/367.1 X |
| 5,762,228 | 6/1998 | Morgan et al. | 220/796 X |

FOREIGN PATENT DOCUMENTS

| | | | |
|---|---|---|---|
| 4-57762 | 2/1992 | Japan | 220/367.1 |

*Primary Examiner*—Stephen K. Cronin
*Assistant Examiner*—Nathan Newhouse
*Attorney, Agent, or Firm*—Rockey, Milnamow & Katz, Ltd.

[57] ABSTRACT

A container system includes a one-piece, one-way valve. The container system can be evacuated by pressing the lid, thereby forcing air out of the one-way valve. The one-way valve does not allow air to enter the container system. The one-way valve includes an interface or release which allows air to enter the container system when the interface is pressed. The one-way valve is preferably an umbrella-shaped valve made of a silicone or plastic.

7 Claims, 2 Drawing Sheets

CONTAINER SYSTEM INCLUDING AN AIR EVACUATION VALVE

FIELD OF THE INVENTION

The present invention relates generally to a container system comprised of a lid and a container unit. More particularly, the present invention relates to an air evacuation system for a container assembly.

BACKGROUND OF THE INVENTION

Container systems such as those described in U.S. Pat. No. 5,356,026 are used in a wide variety of food preparation and storage applications. Container systems generally include a container and a resealable lid. The lid of the container can typically resealably engage an opening. The lid can include an aperture covered by a vent cap. Container systems have been designed to be compact and stackable to reduce the amount of space required to store several systems in a refrigerator, cabinet, closet, shelf, or other unit.

Container systems are utilized in a variety of food storage and preparation applications. For example, container systems are often utilized to store food, such as, fruit, pasta, vegetables, bread, or other edible material. The container system should have a secure seal between the lid and the container to prolong the storage life of the food. The seal also prevents odors from the stored food from interacting with other food items, such as when several food items are contained in a refrigeration unit.

Some container systems have been designed with a mechanism to evacuate or to lower the pressure within the container system. Once the lid is closed onto the container, the evacuation mechanism is manipulated to reduce the pressure in the container system so the food stored in the container system can be preserved for a longer time (e.g., stays fresher). Additionally, the use of an evacuation system assures the user that the lid has been properly sealed to the container. The user hears or otherwise is given feedback information that the lid is not appropriately closed when the evacuation operation fails. Conventional evacuation systems have utilized bulky, complex pumping mechanisms to reduce the pressure within a container system. These complex pumping mechanisms are difficult to manufacture, expensive and interfere with the compact, stackable nature of the container system.

Thus, there is a need for a low-cost, compact container system which can be evacuated by a simple operation. Further, there is a need for a container system which can be evacuated without using a pump or other complex evacuation device. Further still, there is a need for a container system including an air evacuation valve which can be efficiently manufactured.

SUMMARY OF THE INVENTION

The present invention relates to a container system for use in storage applications. The container system includes a container base having an opening, a lid configured to engage the opening, a seal configured to provide an air-tight interface between the lid and the container base, and an evacuation system allowing gas to escape the container system when a portion of the container system is deformed. The evacuation system includes a one-way valve.

The present invention still further relates to a container system including a container base having an opening, a lid with a vent aperture and a valve disposed in the vent aperture. The lid is configured to sealably engage the opening, to cover the container base, and to provide a substantially air-tight interface between the lid and the container base when the lid sealably engages the opening. The valve is configured to allow gas to escape the container system when the lid is deformed and to allow gas to enter the container system when the valve is moved.

The present invention further relates to a plastic container system including a plastic container base, a plastic lid, a plastic seal and a one-piece plastic evacuation device. The plastic container base has an opening defined by a peripheral edge. The plastic lid is configured for the opening and has a sealing rim configured to engage the peripheral edge. The plastic lid has a vent aperture. The plastic seal is disposed between the peripheral edge of the container base and the sealing rim of the lid. The one-way plastic evacuation device is disposed in the vent aperture. The one-way plastic evacuation device allows gas to escape the container system when a portion of the container system is deformed and allows gas to enter the container system when an interface portion is manipulated.

According to one exemplary aspect of the present invention, a seal provides a substantially air-tight interface between the lid and the container base of the container system when the lid engages the opening. The seal is preferably a thermoplastic elastomer (TPE) undersized with respect to, and stretched around, a sealing rim on the lid. When the container system is closed, the seal is disposed between the sealing rim of the lid and an inner surface of a peripheral edge of the container base.

According to another exemplary aspect of the present invention, the seal is L-shaped, with a first portion disposed between a grasping ledge of the lid and a top peripheral edge of the container base, and with a second portion disposed between the sealing rim of the lid and the inner surface of the container base when the container system is closed. The second portion of the seal includes a plurality of ridges or fingers disposed outwardly from the sealing rim to engage and to be deformed against the inner surface of the container base. The outwardly disposed ridges allow the lid to sealably engage the container base, even if minor irregularities in the container base exist. The seal has a recess in its second portion to interface with a corresponding bulge in the sealing rim. The plurality of ridges disposed outwardly from the sealing rim also allow for the lid to be easily disengaged from the container base.

According to yet another exemplary aspect of the present invention, the valve is an umbrella-shaped plug, with a shaft having a length from one-sixteenth inch to one inch. The shaft ends in a point to allow the plug to be easily inserted into the vent aperture. The plug includes a number of rounded members in contact with a top surface of the lid. The valve also includes a feathered periphery for contacting the top surface of the lid. In its resting state, the feathered periphery lies flat against a top surface of the lid, thereby preventing gas from entering the container system through the vent aperture. When the valve is pressed, the number of rounded members acts as a fulcrum to lift the feathered periphery from the top surface, thereby allowing gas to enter the container system.

BRIEF DESCRIPTION OF THE DRAWINGS

The invention will be further described with reference to the accompanying drawings, wherein like numerals denote like elements.

DETAILED DESCRIPTION OF PREFERRED EXEMPLARY EMBODIMENT

Figure 1:
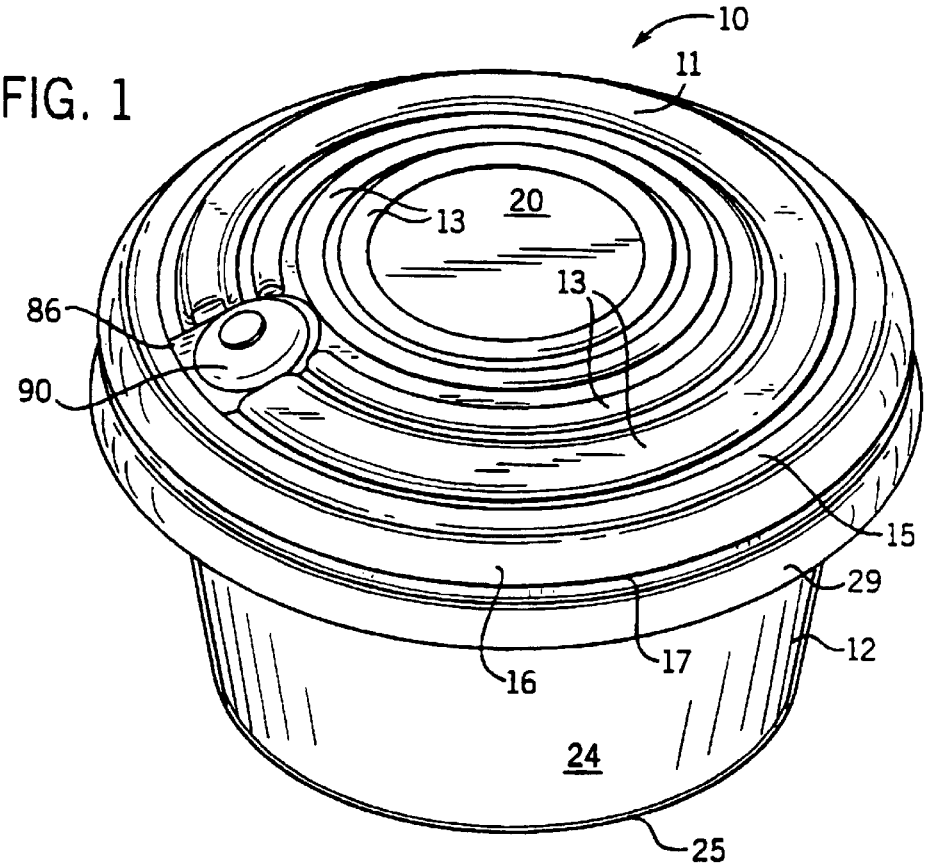
FIG. 1 is a perspective view of a container system having an evacuation device in accord with a preferred exemplary embodiment of the present invention.
Figure 2:
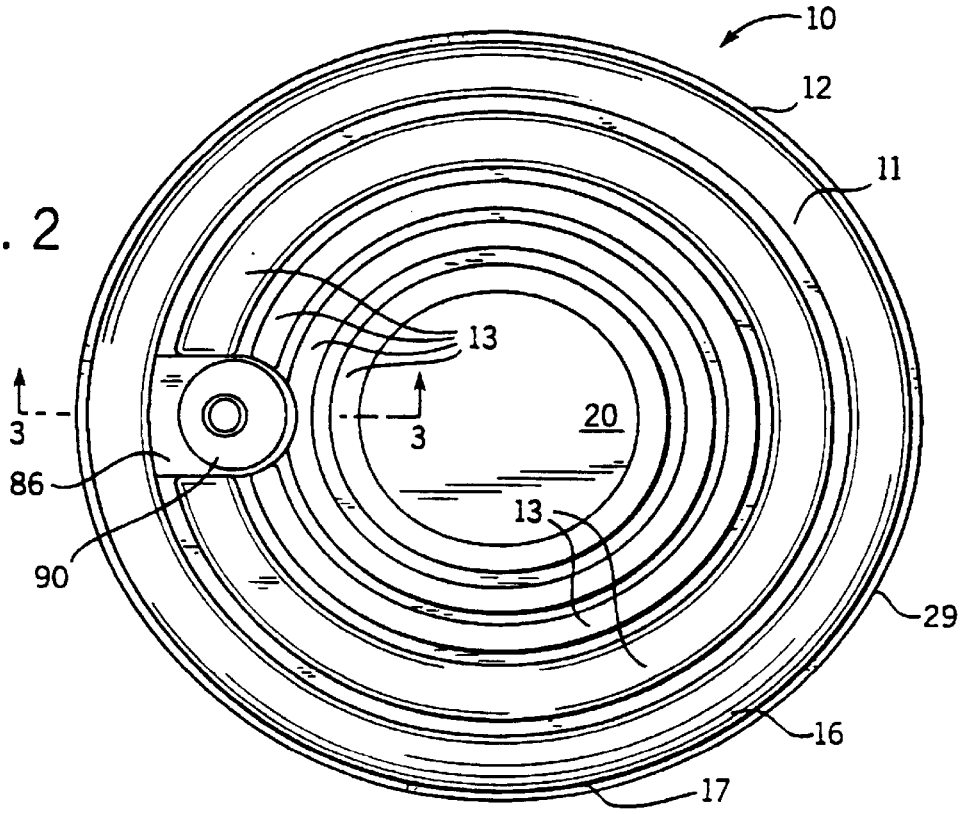
FIG. 2 is a top view of the container system of FIG. 1.
Figure 3:
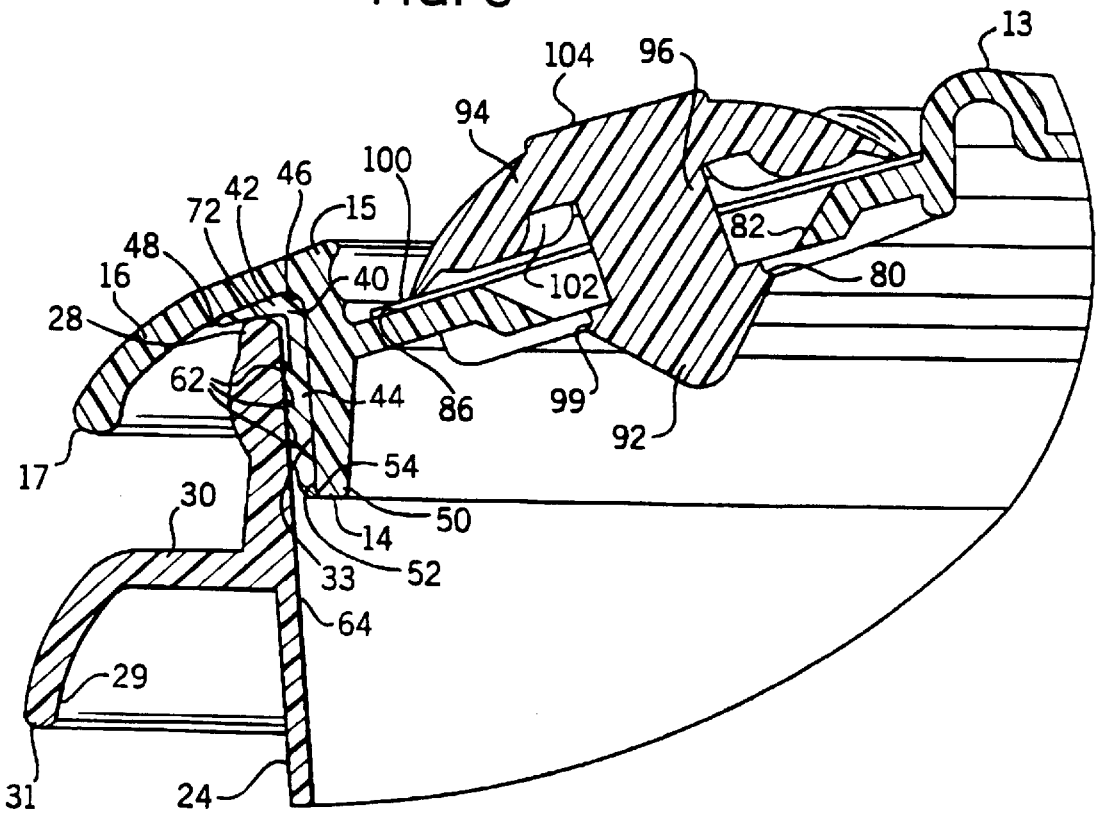
FIG. 3 is a partial cross-sectional view of the container system shown in FIG. 2 about line 3—3.

With reference to FIGS. 1–3, a container system 10 includes a lid 11 and a base or container 12. Lid 11 has four concentric ridges 13, which surround an upwardly circular center portion 20. A rim 14 (FIG. 3) melds into a circular crown portion 15. The lower, radially outermost portion of crown portion 15 melds into a flange area 16 (FIG. 2), which then melds into a circular, outwardly and downwardly curved lip 17. Flange area 16 and lip 17 allow lid 11 to be more easily grasped when removing lid 11 from container 12.

Container 12 includes an upwardly and slightly outwardly inclined circular side wall 24 which is integral with or melds into a bottom wall 25. With reference to FIG. 3, the upper end of side wall 24 terminates at a rim 28, which will be described in greater detail below. A lifting flange 29 attached to side wall 24 is used for grasping and for lifting either container system 10 or just container 12. Flange 29 includes an upper, generally horizontally oriented portion 30 which terminates at its outer periphery in a down-turned portion 31 (FIG. 3). The vertically open space between the bottom of lip 17 of lid 11 and portion 30 of lifting flange 29 forms an opening into which the fingertips of a user may be inserted to disassemble lid 11 from container 12 when both are in the assembled condition (FIG. 1).

With reference to FIGS. 1–3, rim 14 (FIG. 3) of lid 11 includes an interior wall 33 configured to fit within the opening defined by rim 28 of container 12. A gasket or seal 40 is disposed on wall 33 of rim 14. Seal 40 is preferably an L-shaped seal, including a section 42 and a section 44. Section 42 rests between a corner 46 of lid 11 defined by flange area 16 and wall 33 and a ridge 48 formed in flange area 16. Section 44 sits between corner 46 and an end 50 of rim 14.

Preferably, rim 14 includes a bulge 52, and seal 40 includes a groove 54 configured to receive bulge 52. The use of bulge 52 and of rim 48 provides a secure fit for seal 40 on lid 11. Preferably, seal 42 is undersized with respect to rim 14 so seal 40 tightly engages rim 14.

Seal 40 preferably includes three fingers or ridges 62. Ridges 62 engage an interior wall 64 (FIG. 3) below a top 72 of rim 28 of container 12. Ridges 62 provide an air-tight seal superior to conventional single or double seals. Additionally, section 42 of seal 40 provides a seal between top 72 of rim 28 and flange area 16 when lid 11 is firmly placed on container 12. Also, the use of ridges 62 allows lid 11 to slide within container 12 more easily.

With reference to FIG. 3, lid 11 also includes an aperture 80. Aperture 80 is disposed below a recess 82 which is formed in lid 11. Recess 82 preferably has slanted side walls and is circular in shape. Aperture 80 preferably has 90° walls and has a somewhat cross-shaped outline.

Lid 11 includes a flat portion 86 on its top surface. Ridges 13 terminate at flat portion 86 (FIG. 1). Flat portion 86 is generally planar with the top surface of lid 11.

A one-piece, one-way valve 90 (FIG. 3) is disposed through aperture 80. Valve 90 is preferably an umbrella-shaped valve including an arrow-shaped end 92, a C-shaped (in cross-section) top 94, and a shaft 96. End 92 includes notches 99 configured to engage aperture 80. The interface between aperture 80 and end 92 is not an air-tight seal.

Portion 94 includes a feathered end 100 about its circumference for providing an air-tight seal between flat portion 86 and valve 90. Portion 94 also includes egg-shaped or round members 102. Round members 102 engage flat portion 86 when an interface area 104 of valve 90 is pressed.

In operation, when lid 11 is assembled to base 12, lid 11 can be deformed or pressed. As a result, air from within system 10 then escapes through aperture 80 and recess 82 past end 100 of valve 90. Preferably, the air makes a whistling sound as it travels through aperture 80. The deformation of lid 11 increases the pressure within container 12 so air is forced through valve 90 in a simple one motion, manual operation.

When lid 11 is either released or no longer pressed, lid 11 changes to its original shape, and the pressure within container system 10 is decreased. The decreased pressure forces portion 94 down, thereby sealing end 100 against flat portion 86. Thus, a user can evacuate system 10 by merely pressing lid 11 once.

When the user wishes to open system 10, the user presses interface 104, thereby forcing valve 90 down and pushing end 100 up, away from portion 86. Members 102 act as fulcra which lift end 100 from portion 86 when interface 104 is pressed down. When end 100 is lifted from portion 86, air enters container system 10 through aperture 80. When the user releases interface 104, the resilience of portion 94 moves end 92 back into position with respect to aperture 80. However, since the inside of container system 10 has a pressure similar to the environmental pressure, lid 11 can be easily removed from container 12.

Center portion 20 and ridges 13 provide an accordion-like effect for lid 11. Ridges 13 make lid 11 more flexible and more resilient. Additionally, center portion 20 can be pressed down. Moreover, when center portion 20 is compressed, it acquires an inverted bubble shape that further reduces the volume within container system 12.

Seal 40 is preferably made of the same material as lid 11 in a two shot molding process. Seal 40 and lid 11 are preferably manufactured from polypropylene, low density polyethylene, high density polyethylene, a barefoot copolymer, or other plastic. Valve 90 is preferably manufactured from a material similar to lid 11, or seal 40 or from silicone. Seal 40, lid 11 and valve 90 can be a thermal plastic elastomer (TPE) or rubberized elastomer. Container 12 is manufactured from any type of material, preferably plastic similar to lid 11.

Shaft 96 of valve 90 is preferably from approximately ⅛" to 1⅜" in length. Preferably, shaft 96 is approximately ¼" long. End 92 is configured for easy assembly within cross-shaped aperture 80. Lid 11 can have a rough area for easier gripping and deformation of lid 11.

Lid 11 and container 12 of container system 10 can be configured in a variety of fashions to provide a resealable container. For example, double seals or single seals could also be utilized. Additionally, the seals associated with lid 11 and container 12 can be configured to snap when undergoing a sealing engagement and to self-align when lid 11 is placed on top of container 12. Also, latches, fasteners, or other sealing devices can be utilized to couple lid 11 to container 12.

Alternatively, a rectangular container system, a square container system, or an oval container system similar to the system 10 can be utilized. Although interface 104 operates as a push-type interface, a pull-type interface could also be utilized.

It is understood that the above description is of preferred exemplary embodiments of the present invention. The apparatus and method of the invention are not limited to the specific forms shown. For example, although plastic materials are suggested and a circular shape is shown, other materials and geometries can be utilized. Various modifications may be vague to the details of the disclosure without departing from the spirit of the invention which is defined in the appended claims.

What is claimed is:

1. A container system, comprising:

a container base having an opening:

a lid configured to sealably engage the opening and to cover the container base, the lid providing a substantially air-tight interface between the lid and the container base when the lid slidably engages the opening, the lid having a vent aperture;

a valve disposed in the vent aperture the valve allowing gas to escape the container system when the lid is deformed and allowing gas to enter the container system when the valve is moved; and wherein the valve is an umbrella-shaped plug, the plug includes a plurality of rounded members in contact with a top surface of the lid, the plug has a feathered periphery for contacting the top surface of the lid and preventing gas from entering the container system through the vent aperture, and the rounded members act as a fulcrum for lifting the feathered periphery from the top surface to allow the gas to enter the container system through the vent aperture when the valve is pressed.

2. The container system of claim 1, wherein the lid includes accordion ridges disposed on the lid between a center and an outer edge of the lid.

3. The container system of claim 1, wherein gas can be evacuated from the container system by depressing the lid, to force the gas through the valve.

4. The container system of claim 1, wherein the plug includes a shaft having a length from 1 inch to 1/16 of an inch.

5. A plastic container system, comprising:

a plastic container base having an opening defined by a peripheral edge;

a plastic lid configured to cover the opening and having a sealing rim configured for the peripheral edge of the container base, the plastic lid having a vent aperture;

a plastic seal disposed between the peripheral edge of the container base and the sealing rim of the lid; and a one-piece evacuation device including an interface portion and disposed in the vent aperture, the one-way plastic evacuation device allowing gas to escape the container system when a portion of the container system is deformed and allowing gas to enter the container system when the interface portion is manipulated, the plug includes a plurality of rounded members in contact with a top surface of the lid, wherein the plug has a feathered periphery for contacting the top surface of the lid and preventing gas from entering the container system through the vent aperture, the rounded members act as a fulcrum for lifting the feathered periphery from the top surface to allow the gas to enter the container system through the vent aperture when the interface portion is pressed.

6. The plastic container system of claim 5, wherein the seal is L-shaped, and the lid includes a grasping ledge, the seal having a first portion disposed between the grasping ledge and a top of the peripheral edge, and a second portion disposed between the sealing rim and the inner surface when the container system is closed.

7. The plastic container system of claim 6, wherein the seal includes a plurality of ridges on the second portion.

* * * * *